United States Patent [19]

Fadeev et al.

[11] Patent Number: 4,819,542

[45] Date of Patent: Apr. 11, 1989

[54] PERCUSSIVE TOOL

[75] Inventors: Petr Y. Fadeev; Vladimir Y. Fadeev; Vladlen V. Korobkov; Rim A. Kulagin; Nikolai P. Ermilov, all of Novosibirsk, U.S.S.R.

[73] Assignee: Spetsialnoe Konstruktorskoe Bjuro Gidroimpulsnoi Tekhniki Sibirskogo Otdelenia Akademii Nauk SSSR, Novosibirsk, U.S.S.R.

[21] Appl. No.: 124,780

[22] PCT Filed: Dec. 23, 1985

[86] PCT No.: PCT/SU85/00101

§ 371 Date: Aug. 21, 1987

§ 102(e) Date: Aug. 21, 1987

[87] PCT Pub. No.: WO87/03925

PCT Pub. Date: Jul. 2, 1987

[51] Int. Cl.[4] ..... F01B 25/04; F15R 11/22; F01L 25/00; F01L 15/00

[52] U.S. Cl. ..... 91/172; 91/189 R; 91/189 A; 91/291; 91/308

[58] Field of Search ..... 91/50, 172, 189 R, 189 A, 91/286, 290, 291, 296, 308, 319, 321, 235, 417

[56] References Cited

U.S. PATENT DOCUMENTS

| | | | |
|---|---|---|---|
| 2,726,642 | 12/1955 | Zinty et al. | 91/290 X |
| 3,185,040 | 5/1965 | Ligon | 91/319 X |
| 3,774,502 | 11/1973 | Arndt | 91/321 X |
| 3,800,664 | 4/1974 | Phillips | 91/308 X |
| 3,845,694 | 11/1974 | Berg | 91/290 X |
| 4,343,368 | 8/1982 | Fadeev et al. | 173/139 |
| 4,370,916 | 2/1983 | Mitin et al. | 91/189 R X |

FOREIGN PATENT DOCUMENTS

| | | |
|---|---|---|
| 945412 | 7/1982 | U.S.S.R. . |
| 979628 | 12/1982 | U.S.S.R. . |

*Primary Examiner*—Robert E. Garrett
*Assistant Examiner*—Mark A. Williamson
*Attorney, Agent, or Firm*—Fleit, Jacobson, Cohn & Price

[57] ABSTRACT

A percussive tool comprising a housing (1) accommodating a movable striker (2) and connected with a power cylinder (6) in which is arranged a striker shank (4) with a gripping mechanism (14) and a drive in the form of a hydraulic cylinder (8). The percussive tool is provided with a control unit having a spool valve means (18) to control a distribution means (19). The spool valve means (18) has a casing (22) and a spool (23) taking two positions in the casing and defining two chambers (25, 26) interconnected through a throttling means (24). One chamber (25) constantly communicates with a discharge line (21), and the other chamber (26) is periodically put in communication with the space of the hydraulic cylinder (8). The spool (23) is spring-loaded with respect to the casing (22) on the side of one chamber (25) and takes in this case its first position.

5 Claims, 2 Drawing Sheets

PERCUSSIVE TOOL

FIELD OF THE INVENTION

The present invention relates to power impulse systems designed for generating force impulses of a preset frequency and intensity, which act upon the medium being worked so as to deform it, and, more particularly, to percussive tools for creating impact impulses of high power.

Background of the Invention

Known in the art is a percussive device (U.S. Pat. No. 4,370,916, IPC F03 C 1/04, published Feb. 1, 1983) for creating impact impulses to act upon the medium being worked, which device comprises a housing, a striker having a shank, a power cylinder accommodating the striker shank and filled with a compressed gas, a striker gripping mechanism and a striker backward stroke drive in the form of a plurality of hydraulic cylinders having their rods connected to the gripping mechanism and moving under the action of a working fluid fed to the interior space of the hydraulic cylinders during a backward stroke of the striker, and under the action of the compressed gas filling the power cylinder at the moment of the gripping mechanism movement to follow the striker after the forward stroke thereof.

This prior art device operates as follows. When the power cylinder is being filled with the compressed gas the striker is forced by the gas to move to the extreme frontend position. If the interior spaces of the hydraulic cylinders are then connected to a discharge line, the rods under the action of compressed gas pressure applied to their end faces accommodated in the power cylinder will move forward together with the gripping mechanism which will engage the striker at the end of this movement. After this it is necessary to connect the interior spaces of the hydraulic cylinders with a working fluid source. The working fluid fed to the interior spaces of the hydraulic cylinders forces the rods together with the gripping mechanism and the striker coupled therewith to move in the opposite direction compressing still further the gas present in the power cylinder thereby accumulating potential energy. In the extreme rearend position the gripping mechanism releases the striker which under the action of the compressed gas acting upon the end face of the shank is accelerated to move forward and at the end of this movement to deliver a blow at the medium being worked, i.e. the striker performs a working stroke. Then the interior spaces of the hydraulic cylinders are again connected to the discharge line, and the above-described cycle is repeated.

The prior art device has a rather perfect striker backward stroke drive, but for delivering every next blow it is necessary to switch over twice the means which communicate the interior spaces of the hydraulic cylinders with the working fluid source and with the discharge line. Because of such switchings over of said means the frequency of blows is reduced and, as a result, the device output is also reduced.

Summary of the Invention

The invention is aimed at providing a percussive tool wherein connection of interior spaces of hydraulic cylinders with a working fluid source (to cock a striker) and with a discharge line (to move a gripping mechanism to follow the striker after its working stroke) is accomplished automatically.

The percussive tool creates impact impulses which act upon the medium being worked so as to change its form. The tool comprises a housing accommodating a striker adapted to reciprocate, having a front end portion for acting upon the medium being worked and a shank arranged in a power cylinder secured to the housing. The housing is filled with a compressible fluid under pressure for accumulating potential energy when compressed in the process of cocking the striker and for acting upon the end face of the shank of the striker during its working stroke. A striker cocking drive with a gripping mechanism incorporates at least one hydraulic cylinder secured with its body on the periphery of the housing and has a rod. One end of the rod is received in an interior space of the hydraulic cylinder, while the other end is received in an interior space of the power cylinder and connected to the gripping mechanism to interact with the striker during cocking. A control unit is provided with a spool valve means to control a two-position, three-way distribution means which alternately communicates the interior space of the hydraulic cylinder with a working fluid source for cocking the striker and with a discharge line for moving the gripping mechanism to follow the striker after its working stroke. The spool valve means is provided with a casing accommodating a spring-loaded spool capable of taking a first or a second extreme position in the casing of the spool means and defining, with the end faces of the casing of the spool valve means, two chambers constantly interconnected through a throttling means. One of the two chambers is constantly connected with the discharge line, and the other periodically communicates with the interior space of the hydraulic cylinder when the gripping mechanism follows the striker after its working stroke. The spool is spring-loaded with respect to the casing of the spool valve means on the side of one chamber to communicate with the discharge line so as to take its first position under the action of the spring.

Providing the prior art device with the control unit arranged as described above makes it possible to minimize the intervals between the end of the working stroke and the beginning of cocking the striker and thus to increase the frequency of blows which, in turn, improves the efficiency of the device.

Preferably, the throttling means interconnecting the two chambers of the spool valve means be made in the form of an opening in the spool.

Such a throttling means substantially simplifies the construction of the control unit and reduces the length of the connecting line between the chambers.

The other chamber of the spool valve means may be communicated with the interior space of the hydraulic cylinder through an opening made in the body of the hydraulic cylinder, covered by its rod and disposed so as to be uncovered upon completion of the cocking process and after uncoupling of the striker and the gripping mechanism, and additionally through another opening made in the wall of the casing of the spool valve means and covered by the spool in its first position.

This version of communication of the other chamber of the spool valve means with the interior space of the hydraulic cylinder provides a reliable control of the two-position three-way distribution means directly by the agency of the striker cocking drive which increases the reliability of operation of the control unit and the percussive tool as a whole.

In the percussive tools having the hydraulic cylinder rod of large diameter the other chamber of the spool valve means may be suitably communicated with the interior space of the hydraulic cylinder through an opening made in the body of the hydraulic cylinder, which opening being covered by a valve installed therein, interacting with the rod of the hydraulic cylinder and adapted to uncover the opening upon completion of the cocking process and after uncoupling of the striker and the gripping mechanism, and additionally through another opening made in the wall of the casing of the spool valve means and dovered by the spool in its first position.

Such a valve installed in the opening communicating the other chamber of the spool valve means with the interior space of the hydraulic cylinder and interacting with the rod excludes the possibility of working fluid leaks into said other chamber in the process of cocking the striker and in the case of wear of a guide of the hydraulic cylinder rod. Consequently, a spontaneous operation of the control unit is excluded, i.e. the reliability of operation of the percussive tool as a whole is increased.

In some cases the spool valve means is preferably provided with an additional cylinder whose rod is received in another chamber of a spool valve means. Head end space constantly communicates with the interior space of the power cylinder and rod end space constantly communicates with the interior space of the hydraulic cylinder. The other chamber of the spool valve means being in communication with the interior space of the hydraulic cylinder through an opening made in the wall of the casing of the spool valve means and covered by the spool in its first position.

Such an additional cylinder provided in the spool valve means ensures switching over of the spring-loaded spool practically simultaneously with uncoupling of the gripping mechanism and the striker, which, in turn, slightly increases the operational frequency of the percussive tool and, consequently, improves the efficiency thereof.

The two-position three-way distribution means may be made in the form of a spool-type control valve having a spool and a casing made integral with the spring-loaded spool and the casing of the spool valve means.

Combination of the two-position three-way distribution means with the spool valve means considerably simplifies the construction of the control unit, and at the same time improves its operational reliability.

Brief Description of the Drawings

The invention will now be described by way of example with reference to the accompanying drawings in which.

Best Mode of Carrying out the Invention

Figure 1:
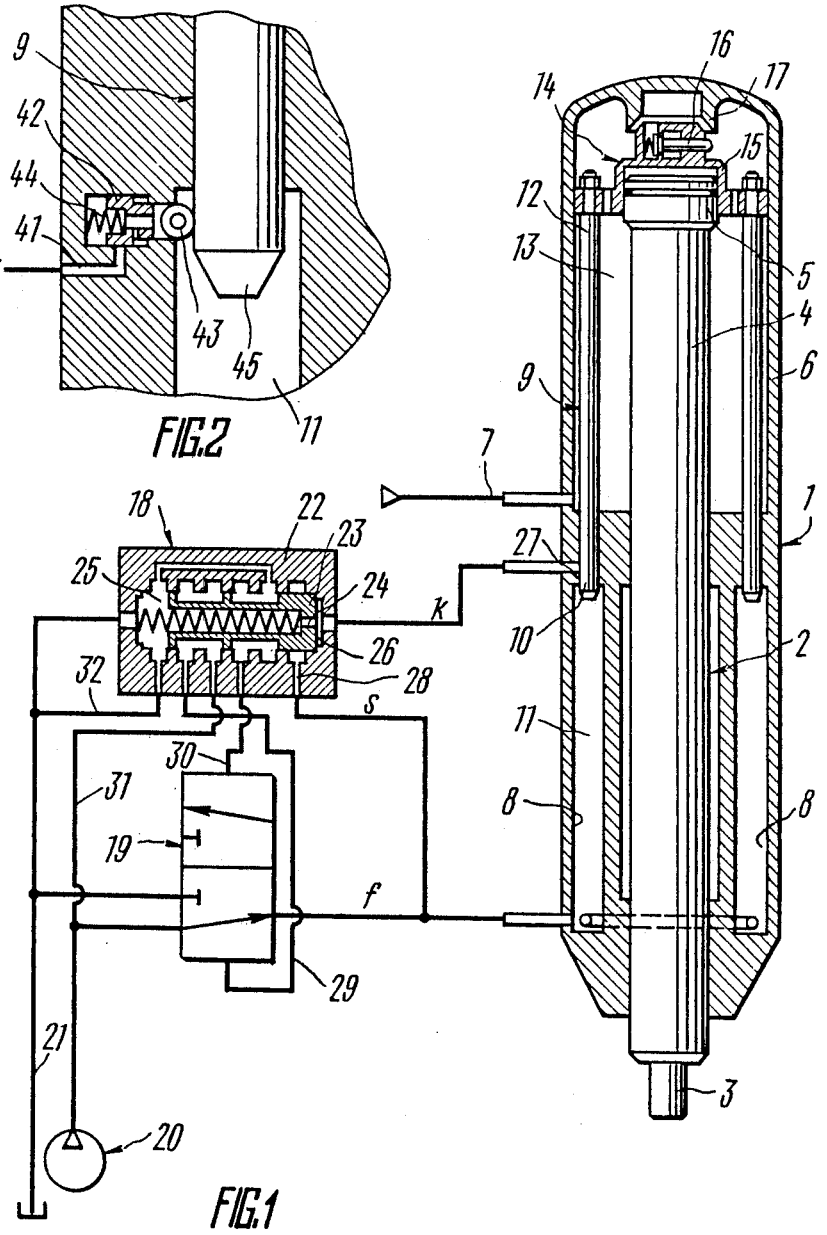
FIG. 1 is a longitudinal sectional view of a percussive tool, according to the invention, having a control unit comprising a spool valve means to control a two-position three-way distribution means.

A percussive tool of the invention is shown in FIG. 1 in a longitudinal section with a control unit incorporating a two-position three-way distribution means (shown schematically) and a spool valve means to control its operation.

The percussive tool comprises a housing 1 accommodating a striker 2 adapted to reciprocate. A front end 3 of the striker 2 is designed to deliver blows at the medium (not shown) being worked. A shank 4 of the striker 2 has a piston 5 at the end thereof and is arranged in a power cylinder 6 attached to the housing 1. The power cylinder 6 is filled with a compressible fluid supplied under pressure through a connecting line 7. The fluid filling the power cylinder 6 is designed for accumulating potential energy when being compressed in the process of cocking the striker 2 and for acting upon the end face of the shank 4 of the striker 2 during the working stroke of the latter.

A drive for cocking the striker 2 is intended to perform the backward stroke of the striker 2 prior to delivering a next blow. It comprises hydraulic cylinders 8 having rods 9, one end 10 of each rod 9 being received in an interior space 11 of the hydraulic cylinders 8 and another end 12 being received in an interior space 13 of the power cylinder 6. A gripping mechanism 14 is located in the interior space 13 of the power cylinder 6. In this particular embodiment, the gripping mechanism 14 has a cup 15 with a spring-loaded valve 16. A cam 17 designed to interact with the valve 16 at the end of the backward stroke of the striker 2 is provided on the rear-end wall of the power cylinder 6.

The above-described specific embodiment of the gripping mechanism is not exhaustive of all possible embodiments of such mechanisms applicable in the tool according to the invention and does not in any way limit the spirit and scope of the invention.

The percussive tool is provided with a control unit comprising a spool valve means 18 and a two-position three-way distribution means 19 controlled by said spool valve means 18. The two-position three-way distribution means 19 is designed to alternately communicate the interior space 11 of the hydraulic cylinders 8 with a working fluid source 20 (the position of the distribution means shown in the drawing) for cocking the striker 2 and with a discharge line 21 for moving the gripping mechanism 14 to follow the striker 2 after the working stroke thereof. The internal arrangement of the distribution means 19 is not important for the spirit of the present invention.

The spool valve means 18 has a casing 22 accommodating a spring-loaded spool 23 capable of taking in the casing 22 of the spool valve means 18 a first extreme position (shown in the drawing) or a second extreme position. End faces of the spool 23 and walls of the casing 22 define two chambers constantly interconnected through a throttling opening 24. One chamber 25 constantly communicates with the discharge line 21, whereas another chamber 26 is periodically put in communication with the interior space 11 of the hydraulic cylinder 8 when the gripping mechanism 14 moves to follow the striker 2 after its working stroke. The other chamber 26 communicates with the interior space 11 of the hydraulic cylinder 8 through an opening 27 made in the body of the hydraulic cylinder 8 and disposed so as to open on completion of the cocking process and uncoupling of the striker 2 and the gripping mechanism 14, the chamber 26 and the opening 27 being connected by means of a line "k". The chamber 26 is additionally connected with the interior space 11 of the hydraulic cylinder 8 through an opening 28 in the wall of the casing 22 and a line "s", the opening 28 being covered by the spool 23 in its first position (as shown in the drawing). In other respects the spool valve means 18 is a spool-type control valve alternately communicating the control spaces of the distribution means 19 through lines 29 and 30 with the working fluid source 20 (through a line 31) and with the discharge line 21 (through a line 32).

Such a control unit provided in the percussive tool ensures the automatic control of delivery of the fluid into the space 11 of the hydraulic cylinder 8 of the striker cocking drive and of discharge of the fluid therefrom, which, in turn, increases the efficiency of operation of the percussive tool at the expense of an increased blow frequency and makes easier the operator's working conditions, since it becomes unnecessary for him to switch over the control means after every blow.

Instead of the opening 27 covered by the side surface of the rod 9, it is possible to communicate the chamber 26 with the interior space 11 of the hydraulic cylinder 8 in another way. In such a case an opening 41 (FIG. 2) communicating through the line "k" the other chamber 26 (FIG. 1) of the spool valve means with the interior space 11 (FIG. 2) of the hydraulic cylinder accommodates a valve 42 covering this opening and interacting with the rod 9 of the hydraulic cylinder by the agency of a roller 43. The valve 42 is adapted to uncover the opening 41 under the action of its spring 44 upon completion of the cocking process and uncoupling of the striker from the gripping mechanism (at this moment a tapered surface 45 of the rod 9 comes under the roller 43 of the valve).

Provision of the valve 42 makes it possible to stabilize in time the moment of feeding the fluid from the interior space 11 (FIG. 1) of the hydraulic cylinder 8 into the other chamber 26 of the spool valve means 18, as in this case it practically does not depend on the gap between the rod 9 and its guide, which may change, e.g. due to wear of the rod 9 and the guide, which, in turn, improves operation of the percussive tool as a whole (especially with large-diameter rods).

Figure 2:
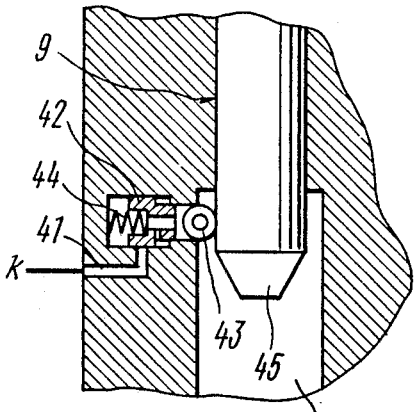
FIG. 2 shows a portion of a hydraulic cylinder body having an opening accommodating a valve covering the opening and interacting with a rod of the hydraulic cylinder, and a portion of a connecting line for communicating said opening with another chamber of the spool valve means.
Figures 3, 4:
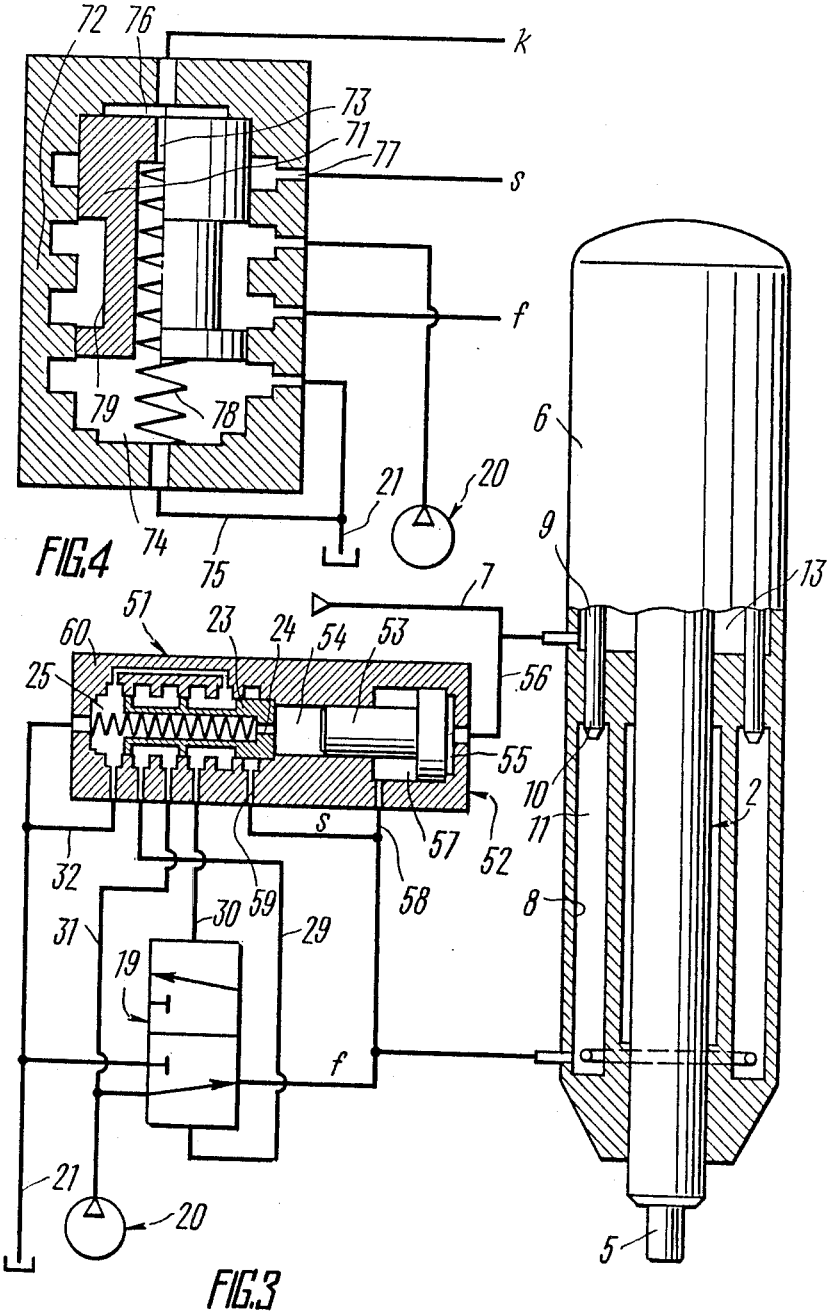
FIG. 3 shows a percussive tool in which a spool valve means has an additional cylinder whose rod is received in the other chamber of the spool valve means.
FIG. 4 shows a two-position three-way distribution means made in the form of a spool-type control valve a spool and a casing of which are made integral with a spring-loaded spool and a casing of the spool-valve means.

The percussive tool having an additional cylinder is shown in FIG. 3. In such an embodiment the striker means proper does not differ from that in the previous embodiments except for absence of both the opening 27 (FIG. 1) and opening 41 (FIG. 2). The main difference of this embodiment consists in that a spool valve means 51 (FIG. 3) is provided with an additional cylinder 52, a rod 53 of which is received in another chamber 54 of the spool valve means 51, a head end space 55 constantly communicates (through a line 56) with the interior space 13 of the power cylinder 6 and a rod end space 57 is in constant communication (through a line 58) with the interior space 11 of the hydraulic cylinder 8, at the same time the other chamber 54 proper is connected (through the line "s") with the interior space 11 of the hydraulic cylinder 8 through an opening 59 made in the wall of a casing 60 of the spool valve means 51 and covered by the spool 23 in its first position.

Employment of the additional cylinder 52 with the rod 53 received in the other chamber 54 makes it possible to reduce practically to zero the time interval between uncoupling of the striker 2 from the gripping mechanism 14 (FIG. 1) and beginning of movement of the spring-loaded spool 23 of the spool valve means to the second extreme position thereof. This contributes to a reduction in duration of the percussive tool operating cycle between two successive blows and, consequently, increases its operational frequency, thereby increasing the efficiency of the percussive tool.

In the percussive tools featuring a moderate flow rate of the working fluid the two-position three-way distribution means may be made in the form of a spool-type valve with a spool and a casing thereof made integral with the spool and the casing of the spool valve means making up a common spool 71 (FIG. 4) and a common casing 72. In this embodiment like in the above-described control units the spring-loaded spool 71 may take a first extreme position (shown in the drawing) and a second extreme position and defines between its end faces and the casing 72 two chambers constantly interconnected through a throttling opening 73, one chamber 74 of which constantly communicates with the discharge line 21 through a line 75 and another chamber 76 is periodically put in communication with the interior space of the hydraulic cylinder through the line "k" and is additionally communicated with the same interior space through an opening 77 in the casing 72, covered by the spool 71 in its first position and further through the line "s". The spool 71 is loaded with a spring 78 on the side of the one chamber 74 so as to take its first position (shown in the drawing). In this position, by means of a groove 79 the spool communicates a line "f" connected to the interior space of the hydraulic cylinder with the working fluid source 20, and in its second position the spool communicates the same line "f" with the discharge line 21.

Combination of the two-position three-way distribution means with the spool valve means simplifies the manufacture of the control unit and improves substantially the operational reliability thereof.

The operation of the percussive tool of the invention will be considered with reference to the embodiment of FIG. 1, some peculiar features in operation of the other embodiments will be additionally explained and specified with reference to the following FIGS.

In the drawing (FIG. 1) the percussive tool is shown at the end of the process of cocking the striker. At that moment the working fluid from the source 20 is fed through the distribution means 19 along the line "f" into the interior space 11 of the hydraulic cylinders 8 and pushes the rods 9 in the direction from the medium being worked (upwards in the drawing). The gripping mechanism 14 of the striker 2 moves together with the rods 9. A vacuum is created between the end face of the piston 5 and the bottom of the cup 15, and under the action of pressure of the fluid contained in the power cylinder 6 on the front end face of the piston 5 the striker 2 moves behind the gripping mechanism. Such joint movement continues until the stem of the valve 16 starts interacting with the cam 17. At this moment the valve 16 will open and connect the cavity of the cup 15 with the interior space 13 of the power cylinder 6. The compressed fluid will fill said cavity of the cup 15 and push the striker 2 by acting upon the end face of its shank 4 with its pressure. The striker 2 rushes forward in the direction of the medium being worked, accelerates and delivers a blow by its front end 3 at said medium being worked. Then the striker 2 stops.

Upon uncoupling of the striker 2 and the gripping mechanism 14 the latter continues to move in the direction from the medium being worked. This movement of the gripping mechanism 14 together with the rods 9 continues till the opening 27 opens. At that moment the working fluid from the interior space 11 through the opening 27 and along the line "k" flows to the other chamber 26 and forces the spring-loaded spool 23 to move to the second extreme position (to the left in the drawing). At the same time the other chamber 26 additionally communicates with the interior space 11 through the uncovered opening 28 and the line "s". Simultaneously the line 29 which has previously been communicated with the working fluid source 20 is connected with the discharge line 21, and the line 30 which has previously been communicated with the discharge line 21 is connected with the working fluid source 20, i.e. the distribution means 19 is switched over. With the distribution means 19 switched over, the line "f" is disconnected from the working fluid source 20 and connected to the discharge line 21. From that moment the rods 9 together with the gripping mechanism 19 start to move forward following the striker 2 in the direction towards the medium being worked, acted upon by the compressible fluid pressure applied to the faces of the other ends 12 of the rods 9 disposed in the power cylinder 6.

In the process of forward movement of the rods 9 and the gripping mechanism 14, in the interior space 11 of the hydraulic cylinders 8 there is maintained the pressure of working fluid practically equal to the pressure of the compressible fluid in the power cylinder 6. This pressure is transmitted through the line "s" to the other chamber 26 and retains the spring-loaded spool 23 in the second extreme position. A portion of fluid flows through the throttling opening 24 into the chamber 25 and therefrom to the discharge line 21.

When moving forward the gripping mechanism 14 approaches the piston 5, and the cup 15 with its cavity starts to slip over the piston 5, the interior space of the cup 15 is isolated from the interior space of the power cylinder 6, the fluid present in the cavity of the cup 15 is additionally compressed and opens by its pressure the valve 16 to flow out therethrough to the interior space 13 of the power cylinder 6.

The gripping mechanism 14 together with the rods 9 stop to move as soon as the bottom of the cup 15 rests against the end face of the piston 5. This moment is characterized by that, first, the valve 16 closes under the action of its spring, second, the pressure in the interior space 11 of the hydraulic cylinders 8 drops to zero, i.e. the factor causing the spring-loaded spool 23 to stay in the second extreme position disappears. The spring-loaded spool 23 acted upon by its spring returns to the initial position (as shown in the drawing) and again communicates the line 29 with the working fluid source 20 and the line 30 with the discharge line 21. Reverse switching over of the distribution means 19 takes place, the line "f" is again put in communication with the working fluid source 20, and the above-described cycle is repeated. With the spring-loaded spool 23 returned to the initial position the fluid from the other chamber 26 is forced through the throttling opening 24 to the chamber 25 wherefrom it freely flows out to the discharge line 21.

As one can see from the description of the percussive tool operation, the operational cycle thereof is repeated fully automatically while the working fluid source 20 supplies the working fluid. The operator's interference is not needed, and the automatic cycle is performed irrespective of the position taken by the striker 2 after delivering a blow at the medium being worked, i.e. it does not depend on the depth of destruction or deformation of said medium being worked.

The foregoing embodiment of the invention features a rather stable operation with moderate diameters of the rods 9. With large diameters of the rods 9 the area of gap between the rod 9 and its guide becomes so great that leakage through this gap to the opening 27 gets sufficient to throw over the spring-loaded spool 23 and the percussive tool starts to operate unstably. This becomes especially noticeable with the guides of the rods 9 being somewhat worn.

The embodiment of the invention provided with the spring-loaded valve 42 (FIG. 2) is free of said disadvantage. This embodiment operates similarly to the previous one with the only difference that the opening 41, the line "k" and, consequently, the other chamber is communicated with the interior space 11 of the hydraulic cylinders when the roller 43 rolls down to the tapered portion 45 of the rod 9 moving in the direction from the medium being worked (upwards in the drawing).

As the rate of flow of the working fluid along the line "k" necessary for displacement of the spring-loaded spool is not high, the valve 42 may have substantially smaller cross-sectional dimension compared to the rod 9. Because of this the gaps in the guides of the valve 42 is also substantially smaller. Moreover, the travel of the valve 42 is much less than that of the rod 9, and hence the wear of the valve guides will be less in the same proportion. All this results in a decreased leakage of fluid along the line "k" with the valve 42 closed, and finally in an improved stability of operation of the percussive tool.

In operation of the above-described embodiments of the invention the connection of the line "k" with the interior space 11 of the hydraulic cylinders should somewhat lag behind the uncoupling of the gripping mechanism and the striker at the end of the process of cocking the latter. Such a lag is necessary since operation of the valve 42 (FIG. 2) or uncovering of the opening 27 (FIG. 1) is not dependent on the completion of the act of uncoupling the gripping mechanism from the striker, but is dependent on the position of the rod 9, i.e. in this case it is necessary to provide such a reserve of time between the opening of the valve 16 (FIG. 1) and the beginning of the forward movement of the gripping mechanism that will ensure a guaranteed release of the striker 2 from the gripping mechanism and performance of the working (forward) stroke thereof.

The foregoing time lag is one of the probable causes of some lengthening of the operational cycle, decrease in the operating frequency of the percussive tool, and, consequently, of a lower efficiency thereof. Provision of the additional cylinder, as shown in FIG. 3, makes it possible to exclude such loss of time and thus to somewhat increase the efficiency of the percussive tool.

The operation of this embodiment differs from the operation of the embodiments described above in the following.

At the end of the striker cocking stroke as soon as the gripping mechanism releases the striker 2, the pressure of the working fluid in the interior space 11 of the hydraulic cylinders drops sharply and becomes practically equal to the pressure of the fluid contained in the interior space of the power cylinder 6. Exactly in the same manner the pressure drops in the rod end space 57 of the additional cylinder, since it is connected through the line 58 with the interior space 11. The pressures in the rod end space 57 and in the head end space 55 will become practically equal. Therefore, the piston together with the rod 53 will move in the direction of the other chamber 54 to increase the pressure of the working fluid in said other chamber 54. The increased pressure in the chamber 54 forces the spring-loaded spool 23 to move to the second extreme position (to the left in the drawing).

Further operation of the percussive tool is similar with operation of the embodiments described above up to the moment of beginning of delivery of the working fluid to the interior space 11 of the hydraulic cylinders 8. From that moment the pressure of the working fluid in the interior space 11 becomes substantially higher than the pressure of the compressible fluid contained in the power cylinder 6, and the piston together with its rod 53 moves to the initial position (shown in the drawing) making the automatic equipment ready for the following operation. Then the operational cycle of the percussive tool is repeated as described above.

As seen from the above explanation, in the percussive tool provided with the additional cylinder used as a signal for displacement of the spring-loaded spool is the fact of uncoupling of the gripping mechanism and the striker at the end of the backward stroke of the latter. This reduces the duration of the operational cycle of the percussive tool, increases the operating frequency and, consequently, the efficiency thereof.

The operation of the percussive tool provided with the three-way spool-type control valve may conveniently be considered after bringing FIG. 1 and FIG. 4 into coincidence. For this purpose, the left-hand side of FIG. 1 beginning with the letters "k", "s", "f" should be replaced by FIG. 4 so as to connect the lines designated with the similar letters in both drawings.

In the process for cocking the striker the spool 71 is in the position shown in the drawing of FIG. 4. At that moment the working fluid from the source 20 is fed through the line "f" to the interior space of the hydraulic cylinders. At the end of the striker cocking stroke upon its uncoupling from the gripping mechanism the working fluid from the interior space of the hydraulic cylinders is fed through the line "k" to the other chamber 76 and forces by its pressure the spool 71 to take the second extreme position (lower one in the drawing). At that moment the line "f" and the interior space of the hydraulic cylinders connected therewith is put in communication with the discharge line 21, and the other chamber 76 communicates through the uncovered opening 77 with the line "s" and, consequently, with the interior space of the hydraulic cylinders. The gripping mechanism starts to move forward to follow the striker forcing by its rods the working fluid out of the interior space of the hydraulic cylinders to the discharge line 21.

While the gripping mechanism is moving forward, the spool 71 is retained in the second extreme position by the pressure of the working fluid fed to the other chamber 76 through the line "s" from the interior space of the hydraulic cylinders.

When the gripping mechanism stops, as described above, the spool 71 acted upon by its spring returns to the initial position (as shown in the drawing of FIG. 4), the working fluid from the other chamber 76 is forced through the throttling opening 73 to the one chamber 74 and therefrom to the discharge line 21. In this case the line "f" is isolated from the discharge line 21 and connected with the working fluid source 20. The operational cycle of the percussive tool is repeated as described above.

From the description of operation of the percussive tool provided with the spool-type control valve in which the spool and the casing are made integral with the spool and the casing of the spool valve means it is seen that in spite of the simple construction of such a control unit, the percussive tool operates automatically, and as shown above, such operation increases the efficiency thereof.

It follows from the description of operation of the percussive tool that all embodiments of the invention can operate automatically and at a higher frequency of blows than in the case of manual control, which in the final analysis exerts a positive effect on the efficiency of the percussive tool according to the invention.

Industrial Applicability

The invention described herein together with the other inventions is used as a basis for developing high-energy hydropneumatic hammers with an impact energy of tens and hundreds of kilojoules. These hammers have no analogs having such technical and operating characteristics, and can find a wide use in the mining, construction, metallurgy and other industries.

What we claim is:

1. A percussive tool for creating impact impulses acting upon the medium being worked so as to change its form, said percussive tool comprising:

a housing accommodating a striker adapted to reciprocate and having a front-end portion for acting upon the medium being worked and a shank arranged in a power cylinder secured to said housing and filled with a compressible fluid under pressure for accumulating potential energy when compressed in the cocking of said striker and for acting upon an end face of said shank of said striker during its working stroke, as well as a striker cocking drive with a gripping mechanism, incorporating at least one hydraulic cylinder secured with its body on a periphery of said housing and having a rod, one end of which is received in an interior space of said hydraulic cylinder and another end is received in an interior space of said power cylinder and connected with said gripping mechanism intended to interact with said striker in the process of cocking thereof, a control unit having a spool valve means to control a two-position, three-way distribution means which alternately communicates said interior space of said hydraulic cylinder with a working fluid source for cocking said striker and with a discharge line for moving said gripping mechanism to follow said striker after its working stroke, said spool valve means being provided with a casing accommodating a spring-loaded spool capable of taking a first or a second extreme position in said casing of said spool valve means and defining by its end faces of said spool valve means two chambers constantly interconnected through a throttling means, one chamber being constantly connected with said discharge line and another chamber being periodically put in communication with said interior space of said hydraulic cylinder when said gripping mechanism follows said striker after its working stroke, said spool being spring-loaded with respect to said casing of said spool valve means on a side of said one chamber communicating with said discharge line so as to take its first position under the action of the spring.

2. A percussive tool according to claim 1, wherein said two-position, three-way distribution means is made in the form of a spool-type control valve having a spool and a casing made integral with said spring-loaded spool and said casing of said spool valve means.

3. A percussive tool for creating impact impulses acting upon the medium being worked so as to change its form, said percussive tool comprising:

a housing accommodating a striker adapted to reciprocate and having a front-end portion for acting upon the medium being worked and a shank arranged in a power cylinder secured to said housing and filled with a compressible fluid under pressure for accumulating potential energy when compressed in the cocking of said striker and for acting upon an end face of said shank of said striker during its working stroke, as well as a striker cocking drive with a gripping mechanism, incorporating at least one hydraulic cylinder secured with its body on a periphery of said housing and having a rod, one end of which is received in an interior space of said hydraulic cylinder and another end is received in an interior space of said power cylinder and connected with said gripping mechanism intended to interact with said striker in the process of cocking thereof, a control unit having a spool valve means to control a two-position, three-way distribution means which alternately communicates said interior space of said hydraulic cylinder with a working fluid source for cocking said striker and with a discharge line for moving said gripping mechanism to follow said striker after its working stroke, said spool valve means being provided with a casing accommodating a spring-loaded spool capable of taking a first or a second extreme position in said casing of said spool valve means and defining by its end faces of said spool valve means two chambers constantly interconnected through a throttling means, one chamber being constantly connected with said discharge line and another chamber being periodically put in communication with said interior space of said hydraulic cylinder when said gripping mechanism follows said striker after its working stroke, said spool being spring-loaded with respect to said casing of said spool valve means on a side of said one chamber communicating with said discharge line so as to take its first position under the action of the spring, said other chamber of said spool valve means being communicated with said interior space of said hydraulic cylinder through an opening made in the body of said hydraulic cylinder, covered by said rod and disposed so as to be uncovered upon completion of the cocking process and after uncoupling of said striker and said gripping mechanism, and additionally through another opening made in a wall of said casing of said spool valve means and covered by said spool in its first position.

4. A percussive tool for creating impact impulses acting upon the medium being worked so as to change its form, said percussive tool comprising:

a housing accommodating a striker adapted to reciprocate and having a front-end portion for acting upon the medium being worked and a shank arranged in a power cylinder secured to said housing and filled with a compressible fluid under pressure for accumulating potential energy when compressed in the cocking of said striker and for acting upon an end face of said shank of said striker during its working stroke, as well as a striker cocking drive with a gripping mechanism, incorporating at least one hydraulic cylinder secured with its body on a periphery of said housing and having a rod, one end of which is received in an interior space of said hydraulic cylinder and another end is received in an interior space of said power cylinder and connected with said gripping mechanism intended to interact with said striker in the process of cocking thereof, a control unit having a spool valve means to control a two-position, three-way distribution means which alternately communicates said interior space of said hydraulic cylinder with a working fluid source for cocking said striker and with a discharge line for moving said gripping mechanism to follow said striker after its working stroke, said spool valve means being provided with a casing accommodating a spring-loaded spool capable of taking a first or a second extreme position in said casing of said spool valve means and defining by its end faces of said spool valve means two chambers constantly interconnected through a throttling means, one chamber being constantly connected with said discharge line and another chamber being periodically put in communication with said interior space of said hydraulic cylinder when said gripping mechanism follows said striker after its working stroke, said spool being spring-loaded with respect to said casing of said spool valve means on a side of said one chamber communicating with said discharge line so as to take its first position under the action of the spring, said other chamber of said spool valve means being communicated with said interior space of said hydraulic cylinder through an opening made in the body of said hydraulic cylinder, which opening being covered by a valve installed therein, interaction with said rod of said hydraulic cylinder and adapted to uncover said opening upon completion of the cocking process and after uncoupling of said striker and said gripping mechanism, and additionally through another opening made in the wall of said casing of said spool valve means and covered by said spool in its first position.

5. A percussive tool for creating impact impulses acting upon the medium being worked so as to change its form, said percussive tool comprising:

a housing accommodating a striker adapted to reciprocate and having a front-end portion for acting upon the medium being worked and a shank arranged in a power cylinder secured to said housing and filled with a compressible fluid under pressure for accumulating potential energy when compressed in the cocking of said striker and for acting upon an end face of said shank of said striker during its working stroke, as well as a striker cocking drive with a gripping mechanism, incorporating at least one hydraulic cylinder secured with its body on a periphery of said housing and having a rod, one end of which is received in an interior space of said hydraulic cylinder and another end is received in an interior space of said power cylinder and connected with said gripping mechanism intended to interact with said striker in the process of cocking thereof, a control unit having a spool valve means to control a two-position, three-way distribution means which alternately communicates said interior space of said hydraulic cylinder with a working fluid source for cocking said striker and with a discharge line for moving said gripping mechanism to follow said striker after its working stroke, said spool valve means being provided with a casing accommodating a spring-loaded spool capable of taking a first or a second extreme position in said casing of said spool valve means and defining by its end faces of said spool valve means two chambers constantly interconnected through a throttling means, one chamber being constantly connected with said discharge line and another chamber being periodically put in communication with said interior space of said hydraulic cylinder when said gripping mechanism follows said striker after its working stroke, said spool being spring-loaded with respect to said casing of said spool valve means on a side of said one chamber communicating with said discharge line so as to take its first position under the action of the spring, said spool valve means being provided with an additional cylinder whose rod is received in an additional chamber of said spool valve means and a head end space of said spool valve means constantly communicates with said interior space of said power cylinder and a rod end space constantly communicates with said interior space of said hydraulic cylinder, said additional chamber of said spool valve means being in communication with said interior space of said hydraulic cylinder, through an opening made in the wall of said casing of said spool valve means and covered by said spool in its first position.

* * * * *